US005924584A

United States Patent [19]

Hellstrom et al.

[11] Patent Number: 5,924,584

[45] Date of Patent: Jul. 20, 1999

[54] CONTAINER CLOSURE WITH A FRANGIBLE SEAL AND A CONNECTOR FOR A FLUID TRANSFER DEVICE

[75] Inventors: Steven P. Hellstrom, Schaumburg; Peter J. Karas, Libertyville; John K. Moore, Evanston; John S. Norman, Gurnee; John C. Tanner, II, Lake Bluff; Donald Verlee, Libertyville, all of Ill.

[73] Assignee: Abbott Laboratories, Abbott Park, Ill.

[21] Appl. No.: 08/807,409

[22] Filed: Feb. 28, 1997

[51] Int. Cl.[6] ..... B65D 39/00

[52] U.S. Cl. ..... 215/247; 215/249; 215/DIG. 3

[58] Field of Search ..... 215/247, 249, 215/DIG. 3

[56] References Cited

U.S. PATENT DOCUMENTS

| | | | |
|---|---|---|---|
| 2,334,905 | 11/1943 | Cherkin | 215/249 |
| 2,342,215 | 2/1944 | Perelson . | |
| 2,388,634 | 11/1945 | De Woody . | |
| 2,524,365 | 10/1950 | Smith . | |
| 2,608,972 | 9/1952 | Chrigstrom . | |
| 2,653,609 | 9/1953 | Smith . | |
| 2,659,370 | 11/1953 | Smith . | |
| 2,667,986 | 2/1954 | Perelson . | |
| 3,343,699 | 9/1967 | Nicko | 215/247 |
| 3,610,297 | 10/1971 | Raaf . | |
| 3,729,031 | 4/1973 | Baldwin . | |
| 3,810,469 | 5/1974 | Hurschman . | |
| 3,826,260 | 7/1974 | Killinger . | |
| 3,872,992 | 3/1975 | Larson . | |
| 3,940,003 | 2/1976 | Larson . | |
| 3,977,555 | 8/1976 | Larson . | |
| 3,995,630 | 12/1976 | van de Veerdonk . | |
| 4,048,999 | 9/1977 | Kobel . | |
| 4,067,440 | 1/1978 | Lataix . | |
| 4,153,057 | 5/1979 | Kobel . | |
| 4,412,623 | 11/1983 | Schmidt . | |
| 4,493,348 | 1/1985 | Lemmons . | |
| 4,505,709 | 3/1985 | Froning et al. . | |
| 4,507,113 | 3/1985 | Dunlap . | |
| 4,564,054 | 1/1986 | Gustavsson . | |
| 4,576,211 | 3/1986 | Valentini et al. . | |
| 4,588,403 | 5/1986 | Wiess et al. . | |

(List continued on next page.)

FOREIGN PATENT DOCUMENTS

| | | |
|---|---|---|
| 0311787 | 9/1988 | European Pat. Off. . |
| 0587347 A1 | 8/1993 | European Pat. Off. . |
| 3152033 A1 | 7/1983 | Germany . |
| 85 32 615.1 | 11/1985 | Germany . |
| 3618158 | 12/1987 | Germany . |
| 1 419 061 | 12/1975 | United Kingdom . |
| 2 235 135 | 8/1990 | United Kingdom . |
| WO 84/04673 | 12/1984 | WIPO . |
| WO 88/01881 | 9/1987 | WIPO . |
| WO 92/11056 | 12/1991 | WIPO . |
| WO 94/03373 | 8/1993 | WIPO . |
| WO 95/0117 | 4/1994 | WIPO . |
| WO 95/33505 | 6/1994 | WIPO . |
| WO 95/14176 | 11/1994 | WIPO . |
| 9503841 | 2/1995 | WIPO . |
| WO 95/31242 | 5/1995 | WIPO . |
| WO 95/35125 | 6/1995 | WIPO . |
| WO 96/13301 | 10/1995 | WIPO . |
| WO 97/00702 | 4/1996 | WIPO . |
| WO 97/10156 | 9/1996 | WIPO . |

*Primary Examiner*—Stephen K. Cronin
*Attorney, Agent, or Firm*—Daniel J. Hulseberg; Brian R. Woodworth

[57] ABSTRACT

A closure is provided for mounting across the mouth of a container and through which liquid can be withdrawn with a fluid transfer device having a male member. The closure includes a body for being disposed on the container across the container mouth. The body defines a passage with an exterior opening for matingly receiving the male member of the fluid transfer device. A frangible seal initially extends across the passage in the body to occlude the passage. The seal is broken when it is engaged by the male member of the fluid transfer device, thereby establishing fluid communication between the fluid transfer device and the interior of the container.

20 Claims, 4 Drawing Sheets

U.S. PATENT DOCUMENTS 4,619,651 10/1986 Kopfer et al. .
4,624,393 11/1986 Lopez .
4,662,878 5/1987 Lindmayer .
4,673,404 6/1987 Gustavsson .
4,675,020 6/1987 McPhee .
4,863,453 9/1989 Berger et al. ..... 215/249 X
4,927,423 5/1990 Malmborg .
4,932,937 6/1990 Gustavsson et al. .
4,951,845 8/1990 Pezzoli et al. ..... 215/250
4,982,740 1/1991 Broden .
4,995,521 2/1991 Von Schuckmann ..... 215/249
5,024,256 6/1991 Vadher .
5,035,689 7/1991 Schroeder .
5,060,812 10/1991 Ogle, II .
5,088,996 2/1992 Kopfer et al. .
5,092,840 3/1992 Healy .
5,169,385 12/1992 Turnbull .
5,215,538 6/1993 Larkin .
5,232,029 8/1993 Knox et al. .
5,275,299 1/1994 Konrad et al. .
5,279,576 1/1994 Loo et al. .
5,297,599 3/1994 Bucheli .
5,342,319 8/1994 Watson et al. .
5,358,501 10/1994 Meyer .
5,360,413 11/1994 Leason et al. .
5,364,386 11/1994 Fukuoka et al. .
5,379,907 1/1995 Niedospial et al. ..... 215/247
5,397,303 3/1995 Sancoff et al. .
5,409,125 4/1995 Kimber et al. .
5,411,499 5/1995 Dudar et al. .
5,415,374 5/1995 Carroll et al. .
5,419,256 5/1995 Kestenbaum .
5,421,814 6/1995 Geary .
5,423,791 6/1995 Bartlett .
5,425,465 6/1995 Healy .
5,429,256 7/1995 Kestenbaum ..... 215/247
5,433,330 7/1995 Yatsko et al. .
5,433,703 7/1995 Utterberg et al. .
5,437,648 8/1995 Graves et al. .
5,441,487 8/1995 Vedder .
5,454,409 10/1995 McAffer et al. .
5,454,805 10/1995 Brony .
5,466,219 11/1995 Lynn et al. .
5,470,319 11/1995 Mayer .
5,470,327 11/1995 Helgren et al. .
5,474,541 12/1995 Ritsky et al. .
5,474,544 12/1995 Lynn .
5,487,737 1/1996 Meyer .
5,501,676 3/1996 Niedospial et al. .
5,509,433 4/1996 Paradis .
5,514,116 5/1996 Vaillancourt et al. .
5,514,117 5/1996 Lynn .
5,520,642 5/1996 Bigagli et al. .
5,520,665 5/1996 Fleetwood .
5,520,666 5/1996 Choudhury et al. .
5,573,516 11/1996 Tyner .
5,573,520 11/1996 Schwartz et al. .
5,573,525 11/1996 Watson et al. .
5,573,526 11/1996 Hess .
5,616,130 4/1997 Mayer .
5,620,434 4/1997 Brony .

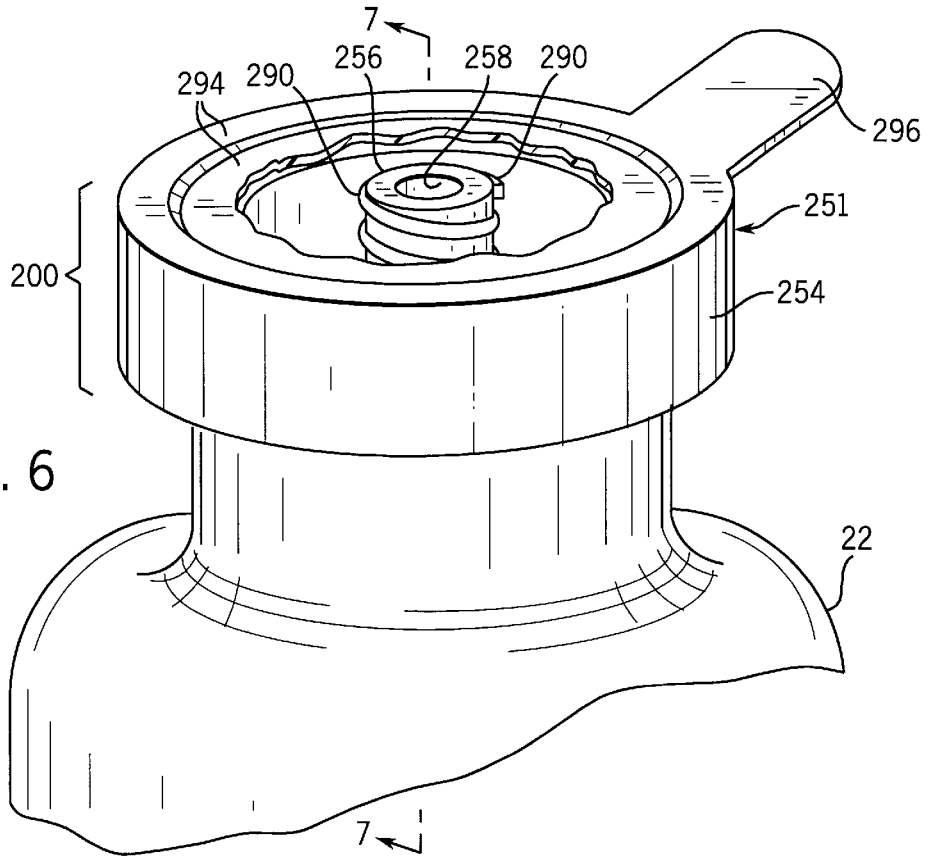
FIG. 6
FIG. 7
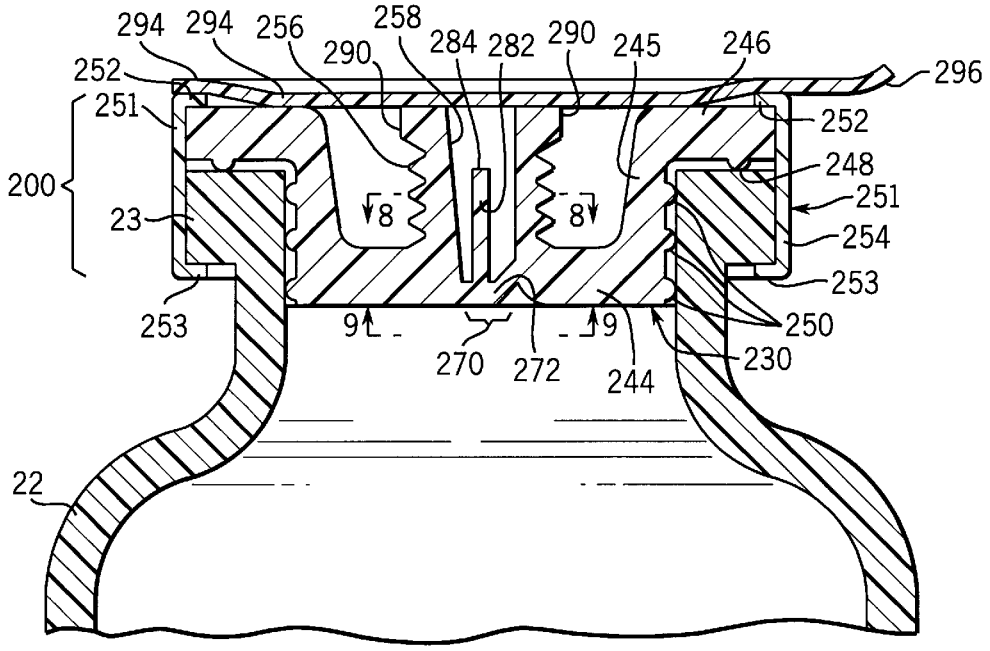

CONTAINER CLOSURE WITH A FRANGIBLE SEAL AND A CONNECTOR FOR A FLUID TRANSFER DEVICE

CROSS REFERENCE TO RELATED APPLICATION(S)

Not Applicable

STATEMENT REGARDING FEDERALLY SPONSORED RESEARCH OR DEVELOPMENT

Not Applicable

TECHNICAL FIELD

The present invention relates to closures for containers, including vials and the like, containing pharmaceutical products or non-pharmaceutical products. The present invention is directed to a closure for containing and delivering a product from a container. More particularly, the present invention is directed to a closure that permits the introduction and withdrawal of fluid from a container using an instrument having a blunt fitting or connector, such as a luer lock syringe or other fluid transfer device.

BACKGROUND OF THE INVENTION AND TECHNICAL PROBLEM POSED BY THE PRIOR ART

Many pharmaceutical products are delivered to pharmacies in sealed containers such as glass or plastic vials, glass or plastic bottles, and flexible bags. Such containers can contain a powdered or lyophilized formulation of a pharmaceutical product that must be reconstituted prior to administration to a patient. In addition, such containers can contain a solution or suspension formulation of a pharmaceutical product that can be withdrawn from the container and administered directly to a patient, for example, by parenteral administration.

Most pharmaceutical vials are sealed by a pierceable stopper which is press-fit into the mouth of the vial to thereby isolate the contents of the vial from the vial's external environment. In order to access the pharmaceutical product within the vial, it is necessary either to pierce the stopper or to remove the stopper from the vial. However, removal of the stopper results in exposure of the pharmaceutical product to the external environment of the vial, thereby compromising the sterility and/or stability of the pharmaceutical product within the vial. For this reason, it often is preferable to access the pharmaceutical product by piercing the stopper.

A conventional syringe can be used to add a diluent to, and/or to withdraw liquid from the vial. Such a syringe has a sharp, hollow cannula or needle which is pushed through the stopper and into communication with the liquid. The syringe plunger can be depressed to dispense a diluent into the vial and/or pulled outwardly to draw liquid from the vial into the syringe.

The piercing of vial stoppers typically has been achieved through the use of sharp, small-bored needles. Standard hypodermic syringe needles are particularly useful for this purpose because they allow the pharmaceutical product to be aseptically withdrawn from the vial and parenterally administered directly to a patient using a single device, thereby minimizing risk of contamination of the pharmaceutical product.

While the above-described conventional system has long been used with satisfactory results, it is not without disadvantages. A fundamental disadvantage is the necessity of using a syringe with a sharp needle. This exposes the medical professional to the possibility of being accidently pricked by the syringe needle. In addition to the undesirable injury resulting from such an accidental needle prick, there may be a risk of contamination of the needle by the medical professional. If the medical professional violates safe procedures and continues to use a contaminated syringe to withdraw the liquid medicament from the vial and administer it to a patient, there is a risk of transmitting the contaminant to the patient.

In addition, if the syringe needle is used to inject the liquid medicament into a patient, there is a danger that the medical professional could accidentally be pricked by the needle following the injection of the patient. This could expose the medical professional to contamination from the patient, especially pathogens carried in blood.

It would be desirable to provide an improved closure system that would permit reconstitution and withdrawal of liquid medicament from a closed vial without requiring the use of a syringe having a sharp needle.

It would also be advantageous to provide such an improved system which would provide simple and rapid access to the medicament contained within the vial.

Preferably, such an improved system should accommodate current product designs and manufacturing techniques to as great an extent as possible. Also, it would be desirable if such an improved system could be employed with conventional, luer devices. Further, such an improved system should preferably accommodate the design of components that can be manufactured at very low cost, with mass production techniques, with low product reject rates, and with high reliability.

Additionally, it would be desirable if the improved design could be easily operated to establish a reliable communication between the syringe or other luer device and the medicament in the vial in a way that would minimize the possibility of interrupted or reduced flow.

Further, it would be beneficial if such an improved design could provide tamper-evidence.

The present invention provides an improved container closure which can be accessed with a blunt fluid transfer device such as a luer lock syringe that can accommodate designs having the above-discussed benefits and features.

SUMMARY OF THE INVENTION

According to the present invention, a subassembly of components is provided for being secured over the mouth of a container. The closure facilitates the simple and rapid fluid connection between a fluid transfer device and the closure assembly. The connection operates to open the closure assembly and establish communication with the contents within the container. The closure includes features which provide evidence of prior opening or tampering. The closure may include a lid for closing the closure after it has been opened.

In the preferred form of the invention, the closure is adapted for mounting across the mouth of a container. The liquid or other fluid can be transferred into or out of the container with a fluid transfer device including a male member. Such a device may be a conventional luer lock syringe or other conventional fluid transfer device.

The closure includes a body for being disposed on the container across the container mouth to initially occlude the container mouth. The body defines a passage with an exterior opening for matingly receiving the fluid transfer device male member.

A frangible seal is provided to initially extend across the passage and sealingly occlude the passage. The seal can be broken when engaged by the male member of the fluid transfer device. This establishes fluid communication between the device and the interior of the container.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 6 is a perspective view of the container with a second embodiment of the closure of the present invention;

FIG. 7 is a fragmentary, cross-sectional elevational view of the second embodiment of the closure on the container shown in FIG. 6;

DESCRIPTION OF THE PREFERRED EMBODIMENTS

Figure 3:
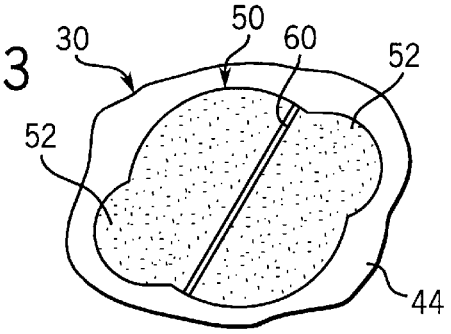
FIG. 3 is a cross-sectional view of the closure taken generally along the plane 3—3 in FIG. 2 to show the top of a frangible seal.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the components of this invention are described as they are depicted in the accompanying figures, and terms such as upper, lower, horizontal, etc., are used with reference to this position. It will be understood, however, that the components of this invention may be manufactured, stored, transported, used, and sold in an orientation other than the position described.

A first embodiment of a closure of the present invention is illustrated in FIGS. 1–5 and is designated generally therein by the reference number 20. The closure 20 is mounted to a container 22, such as a vial, which has an annular flange 23 defining the mouth of the container.

The container 22 can be a pharmaceutical vial of known construction. However, it will be appreciated that closure 20 can be adapted to seal a wide variety of containers. The depiction herein of a pharmaceutical container or vial 22 is not intended to be limiting, but instead represents one useful application of the system of the present invention. The container 22 also can be a plastic or glass bottle or a flexible bag of known construction. Further, the container 22 can be a tube set for parenteral or enteral administration applications. For the purposes of this disclosure, all references to the term "container" are intended to include, inter alia, vials, bottles, flexible containers, and parenteral and enteral tube sets.

Figure 2:
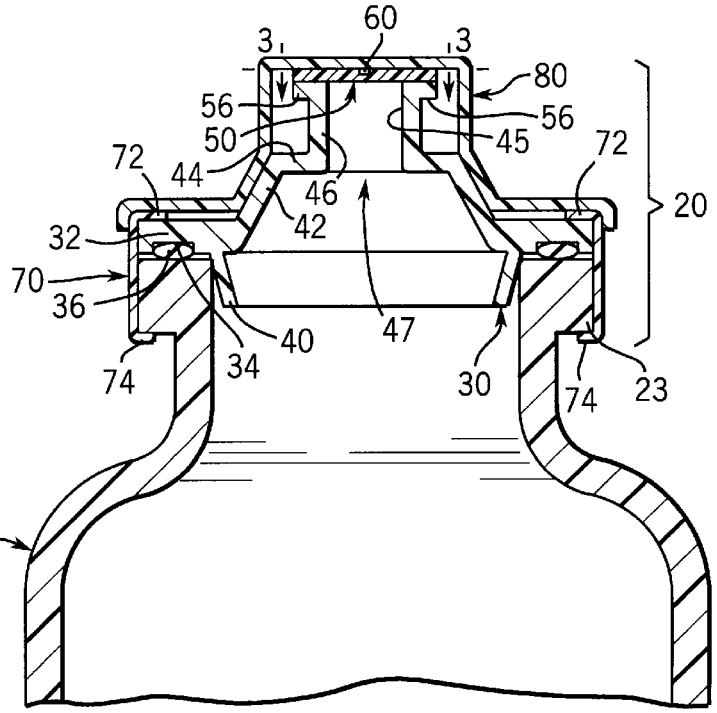
FIG. 2 is a fragmentary, cross-sectional, elevational view of the container and closure shown in FIG. 1.
Figure 4:
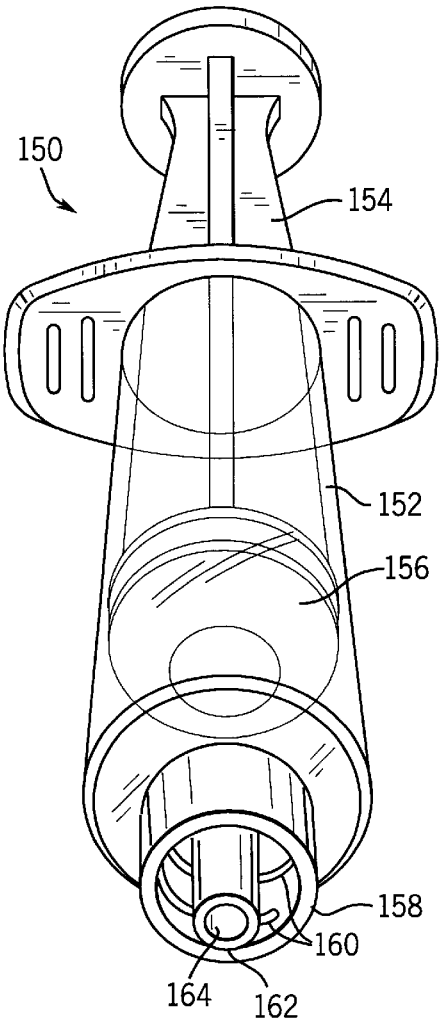
FIG. 4 is a perspective view of a luer lock-type syringe.

The closure 20 is disposed across the mouth of the container 22. The closure includes a body 30 (FIG. 2). The body 30 includes an annular flange 32 adapted to be disposed over the top of the annular flange 23 of the container 22. The body flange 32 preferably defines one or more downwardly open annular grooves 34 for receiving O-ring type seals 36 for establishing a liquid-tight seal between the body 32 and the container flange 23. In the alternative, element 36 can be an energy director element that can be used to ultrasonically weld closure 20 to container 22. Such energy director elements are well known in the ultrasonic welding art.

The body 30 includes a skirt 40 which extends downwardly from the lower side of the flange 32 and has a generally frustoconical configuration. The body 30 also has an annular, upper wall 42 extending upwardly from the upper side of the flange 32. The upper wall 42 has a generally frustoconical configuration.

The upper end of the wall 42 terminates in a transverse, horizontal, annular deck 44. The inner edge of the annular deck 44 terminates in an upwardly extending, generally cylindrical, spout 46. The spout 46 defines an interior bore 45, at least a portion of which is preferably frustoconical with a cone angle of 3.4° corresponding to a typical luer taper (i.e., a 1.7° side taper).

Together, the inner edge of the body flange 32, the downwardly extending skirt 40, the upper wall 42, the annular deck 44, and the spout bore 45 define a passage 47 which communicates with the interior of the container 22. The upper end of the spout 46 defines an exterior opening which is initially covered and sealed with a frangible seal 50. The seal 50 has a generally disk-like, circular configuration with two oppositely extending semicircular tabs 52 (FIG. 3). Each tab 52 is secured to, and is generally in registry with, an underlying, outwardly extending lug 56 (FIG. 2) at the top of the body spout 46. Each lug 56 functions as a luer lock thread form or thread engaging member for threadingly engaging an internal thread in a skirt of a luer lock connection of a liquid transfer device such as a syringe as described in more detail hereinafter.

The frangible seal 50 initially extends across the passage 47 defined by the body 30 so as to occlude the passage. The seal 50 can be broken when engaged by a fluid transfer device, such as a syringe, that can be connected to the body 30 as described in detail hereinafter. The seal 50 may optionally include a groove 60 defined by a reduced cross-sectional thickness in the seal. The groove 60 functions as a line of weakening to aid in rupture of the seal 50.

The seal 50 is preferably a synthetic polymer film which is heat-sealed or adhesively secured to the upwardly facing top surface of the spout 46, including the upwardly facing, top surfaces of the spout lugs 56. The seal 50, when secured across the top of the spout 46, provides a barrier against ingress of contaminants.

Preferably, the closure body 30 is securely held to the container 22 by means of an annular ferrule 70. In one contemplated embodiment, the ferrule 70 is a generally cylindrical metal ring having an upper deck or peripheral edge 72 extending inwardly around the upper peripheral edge of the closure body flange 32, and a lower peripheral portion 74 crimped under the bottom edge of the flange 23 of container 22.

Figure 1:
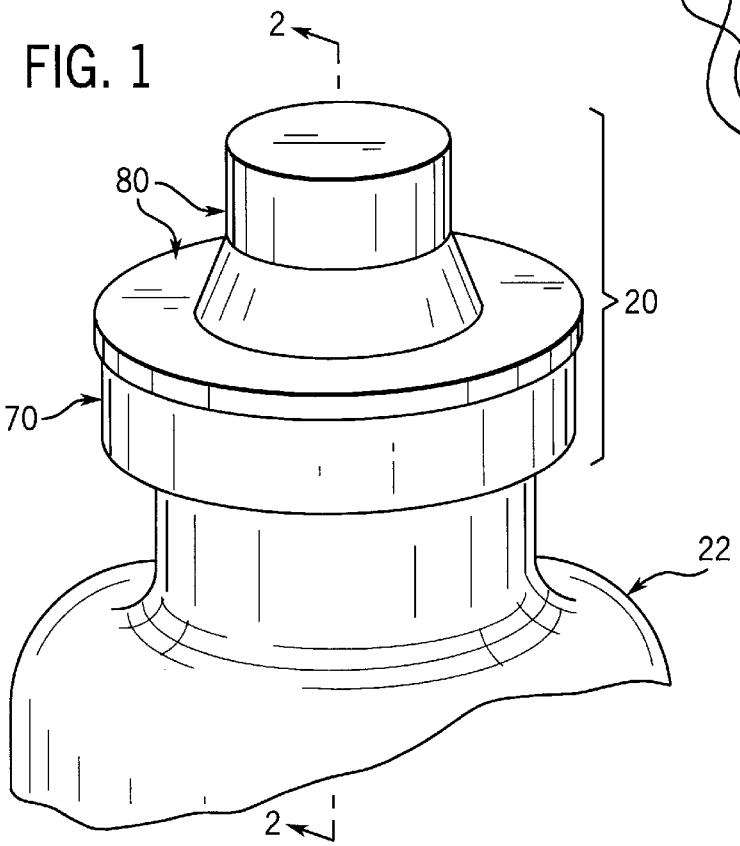
FIG. 1 is a perspective view of a container or vial with a closure of the present invention.

In the preferred embodiment illustrated in FIGS. 1 and 2, an anti-microbial cover 80 (FIGS. 1 and 2) is disposed over the seal 50, over the closure body 30, and over the upper peripheral edge 72 of the ferrule 70. The cover 80 may be adhesively secured to the body 30 and/or ferrule 70. Alternatively, the cover 80 may be mounted to the ferrule 70 in a snap-fit engagement. In a further contemplated embodiment (not illustrated), the cover 80 may be hingedly connected to the ferrule 70 at one location on the periphery of the ferrule, while at another peripheral location the ferrule 70 and cover 80 may cooperatively define a snap-fit latch.

It will also be appreciated that the ferrule 70 may be made from a synthetic thermoplastic, polymer material instead of metal. If the container or vial 22 is of a compatible thermoplastic material, then such a thermoplastic ferrule 70 can be heat-sealed or welded to the flange 23 of the vial 22 rather than crimped. Alternatively, the vial 22 and ferrule 70 can be adhesively secured together.

Also, the ferrule 70 can be secured to the closure body 30 by other means. If the closure body 30 is made from a thermoplastic polymer, and if the ferrule 70 is made from a compatible thermoplastic polymer, then the two components may be heat-sealed or welded together. Alternatively, the two components may be secured by a suitable adhesive.

When it is desired to gain access to the contents within the vial 22, the medical professional first opens or removes the cover 80, if such a cover is provided. This exposes the upper surface of the seal 50. The user may then wipe or swab the upper surface of the seal 50 if that is desired. However, if the components of the closure 20 are assembled and mounted to the vial 22 in an appropriate sterile environment and/or if the components or the completed closure 20 have been suitably sterilized, then there may be no need to swab the upper surface of the seal 50 with alcohol or similar anti-microbial agent, especially if the container is held in a sterile filling hood as the cover 80 is removed and as the closure 20 is connected to a fluid transfer device, such as a luer lock syringe (described in detail hereinafter).

The seal 50 can be conveniently broken by introducing a fluid transfer device into the closure 20 after the cover 80 has been removed. One such device is a conventional luer lock syringe 150 illustrated in FIG. 4. It is to be understood that luer lock syringe 150 is depicted in the accompanying figures and described herein only for illustrative purposes. The present invention is not intended to be limited to luer lock syringe applications.

The luer lock syringe 150 includes a barrel 152 and a telescopically received plunger 154. The distal end of the plunger 154 includes a conventional piston or grommet 156 sealingly engaged with the interior cylindrical surface of the barrel 152.

The distal end of the syringe 150 has a conventional annular skirt 158 which is internally threaded with a conventional luer lock-type dual lead helical thread system 160. A conventional male member 162 projects from the distal end of the barrel 152 within the annular skirt 158. The male member 162 has a conventional, exterior, luer taper which reduces the exterior diameter of the male member 162 to a minimum at the bottom, distal end of the male member 162. The male member 162 defines a bore 164 which is in communication with the interior volume of the syringe barrel 152 below the syringe plunger piston 156.

Figure 5:
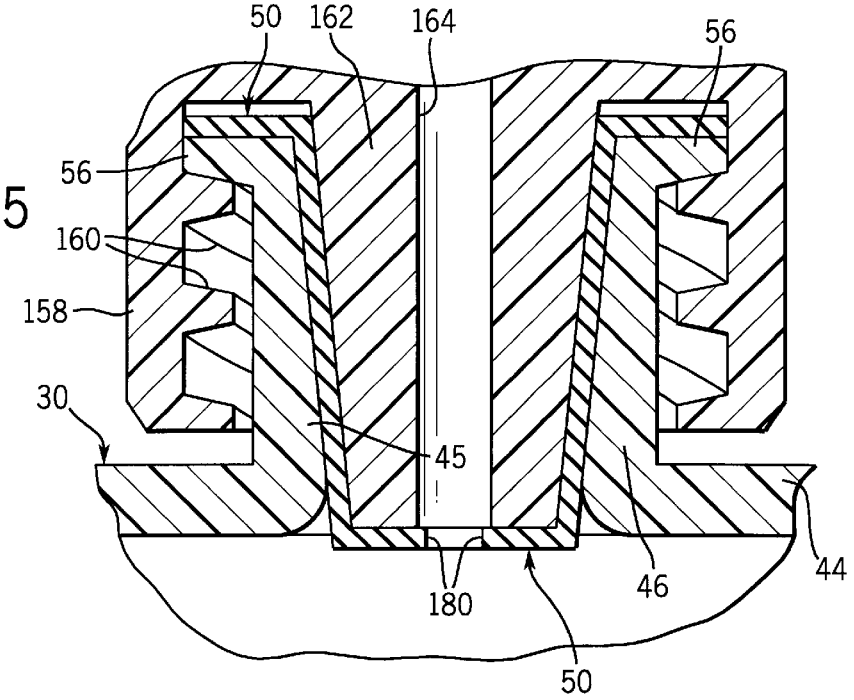
FIG. 5 is a view similar to FIG. 2, but FIG. 5 shows the syringe connected to the container.
Figure 10:
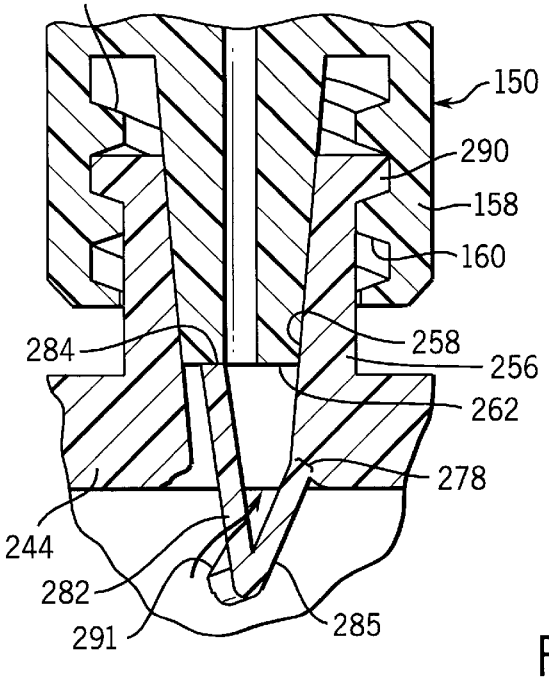
FIG. 10 is a view similar to FIG. 7, but FIG. 10 shows the syringe connected to the closure to rupture the frangible seal in the closure.

As shown in FIG. 5, the luer lock syringe 150 can be coupled with the container 22 through the closure 20. The syringe 150 is threadingly engaged with the luer lock lugs 56 on the closure spout 46. As relative rotation is effected between the syringe 150 and the container 22, the male member 162 of the syringe 152 moves downwardly against the seal 50.

As the syringe 150 is threaded onto the lugs 56 of the closure body 30, the seal 50 is stretched downwardly and eventually ruptures or breaks. The break preferably occurs along the groove 60 (FIG. 3) if such a groove is provided in the seal. Groove 60 can have a variety of configurations, including a V-shaped cross-section. In an alternative embodiment, groove 60 is formed as a slit traversing a portion of the thickness of seal 50. In this embodiment, groove 60 can be formed across the entire face of seal 50, or can be formed only on a portion of seal 50. Even if such a groove 60 is not provided, the seal 50 breaks substantially across the middle of the seal where the deformation is at a maximum. The rupture of the seal 50 creates an opening 180 through the seal 50, and this establishes communication between the interior of the vial 22 and the bore 164 of the male member 162 extending from the syringe 150. Interior bore 45 preferably is configured to provide a substantially fluid-tight seal with male member 162 when male member 162 is inserted therein, thereby prevent the contents of container 30 from leaking around male member 162.

Next, the medical professional can initially depress the syringe plunger 154 to force air (or a diluent) contained within the syringe into the vial 22. The vial 22 preferably is tipped or inverted to facilitate withdrawal of the vial's contents. The syringe plunger 154 is retracted to draw the contents of the vial 22 into the syringe 150.

When the syringe 150 is disengaged from the closure 20, the previously removed cover 80 can be reattached to, or otherwise mounted on, the broken seal 50 and closure body 30. This provides a barrier against contaminant ingress. This also permits any contents remaining in the vial 22 to be later accessed by again removing the cover 80. Addition protection against contaminant ingress can be provided by constructing seal 50 such that it returns substantially to its original, closed position after syringe 150 is withdrawn from interior bore 45. In order to effect such a closure, seal 50 is preferably constructed of an elastomeric material.

In some applications, it may be desirable to omit the cover 80 altogether from the closure 20. In such a design, the outwardly facing upper surface of the seal 50 would then be exposed to the environment and to contaminants. Prior to breaking the seal 50 by attaching a syringe 150 or other suitable fluid transfer device, the upper surface of the seal 50 should preferably be wiped with alcohol or other similar anti-microbial agent. This may be done under a sterile filling hood.

FIGS. 6–12 illustrate a second embodiment of the closure of the present invention which is designated in FIGS. 6–12 generally by the reference number 200. The closure 200 is adapted to be mounted to the container 22 previously described with reference to the first embodiment of the closure shown in FIGS. 1–5.

In particular, the container or vial 22 has a neck which terminates in an annular flange 23 around an opening or mouth and which receives the closure 200. The closure 200 includes a body 230 (FIG. 7) having a transverse cross wall 244, an annular, generally cylindrical wall 245 extending upwardly from the cross wall 244 and an annular flange 246 extending radially outwardly from the upper end of the annular wall 245. The flange 246 is adapted to be disposed over, and generally in registry with, the upper surface of the flange 23 of the vial 22. Preferably, the lower, downwardly facing surface of the closure body flange 246 defines one or more annular beads 248 for engaging the top surface of the flange 23 of the vial 22 so as to establish a leak-tight seal.

Also, one or more seals may be established between the closure body 230 and the inside, cylindrical surface of the neck of the vial 22. To this end, the exterior surface of the closure body wall 245 includes one or more annular seal beads or O-rings 250. In the preferred embodiment, three annular beads or O-rings 250 are provided on the exterior surface of the closure body wall 245.

As depicted in FIG. 7, closure 200 can be configured such that flange 246 rests on top of flange 23 of container 22. However, it is to be appreciated that closure 200 can also be constructed such that closure body 230 rests directly on flange 23 of container 22. For example, if closure 230 is constructed to be placed in a container having a 20 mm opening in the manner depicted in FIG. 7, the same closure 230 can be used with a container having a smaller opening, e.g., 13 mm, provided closure body 230 is placed on flange 23 rather than within container 22. It will be appreciated that flange 246 can be modified or even omitted if closure body 230 is constructed for placement directly on flange 23 of container 22. For the purposes of the disclosure herein, the embodiment depicted in FIG. 7 will be described. However, such disclosure is intended to cover both configurations of this embodiment of the present invention.

The closure body 230 may be press-fit into the mouth of the vial 22 and retained therein by compressive engagement. To this end, the exterior diameter of the seal beads 250, as measured prior to insertion of the closure body 230 into the mouth of the vial 22, is slightly larger than the internal diameter of the vial mouth.

A generally cylindrical spout 256 projects upwardly from the closure body cross wall 244 (FIG. 7). The spout 256 defines an internal passage 258 which is initially closed at the bottom by a portion of the body cross wall 244. The spout 256 has an upper, distal end which defines an exterior opening of the passage 258. In the depicted embodiment, the exterior of the spout 256 includes a pair of oppositely oriented, laterally projecting formations or lugs 290 for engaging an internal thread of a luer lock syringe annular skirt, such as the syringe 150 described above with reference to FIG. 4.

Preferably, additional means are used to retain the closure body 230 on the vial 22. In the preferred embodiment illustrated in FIGS. 6–12, a ferrule 251 is employed for that purpose. In one contemplated embodiment, at the ferrule 251 is a metal ring which includes an annular skirt 254, an inwardly extending upper deck or peripheral edge 252 which is disposed over the closure body flange 246, and a lower peripheral edge 253 which is crimped over the flange 23 of the vial 22. An adhesive may be used in addition to, or instead of, crimping the ferrule 251.

Ferrule 251 may be made from a synthetic polymer material, such as a thermoplastic polymer. If the vial 22 is made from a thermoplastic material and if the closure body 230 is made from a thermoplastic material, then the three components may be secured together by heat welding or heat sealing. The ferrule 251 can also be formed together with the closure body 230 as a unitary structure. Alternatively, the ferrule 251 could be formed together with the vial 22 as a unitary structure.

The closure body 230 includes a frangible seal 270 at the bottom of the passage 258 within the spout 256. The frangible seal 270 is preferably a unitary part of the closure body cross wall 244 and may be more particularly characterized as including a generally flap-like portion or transverse wall portion 272 (FIG. 9) which has a substantially disk-like configuration.

Figure 8:
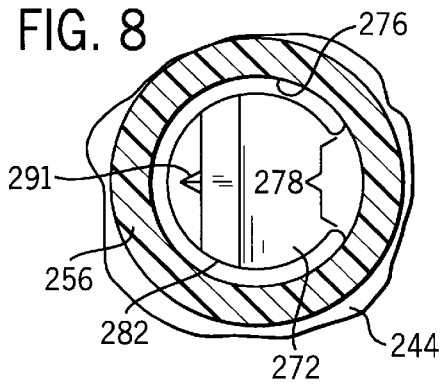
FIG. 8 is a cross-sectional view taken generally along the plane 8—8 in FIG. 7.
Figure 9:
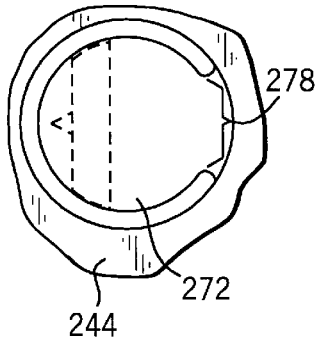
FIG. 9 is a fragmentary, bottom plan view taken generally along the plane 9—9 in FIG. 7.
Figure 11:
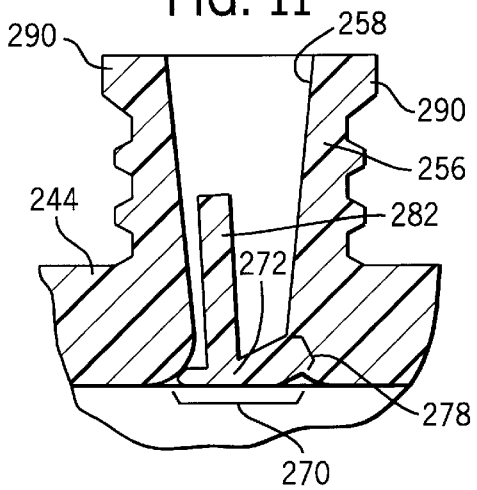
FIG. 11 is a view similar to FIG. 10, but FIG. 11 shows the opened closure after the syringe has been removed.

The closure body transverse wall 244 surrounding part of the flap-like transverse sealing wall portion 272 has a reduced thickness connecting web 276 which frangibly connects only a portion of the periphery of the flap-like transverse wall portion 272 to a first adjacent region of the transverse wall 244. Preferably, the reduced thickness connecting web 276 is defined by an upwardly open groove having the configuration of an arc of a circle. The remaining periphery of the flap-like transverse wall portion 272 is permanently connected to a second adjacent region of the body transverse wall 244 so as to define a hinge connection 278 (FIGS. 8 and 9). The hinge connection 278 comprises a section of material which is thicker than the reduced thickness connecting web 276.

An engaging protuberance 282 (FIGS. 7 and 8) projects upwardly from the flap-like transverse wall portion 272 within the spout 256. The protuberance 282 has a distal end 284 for being engaged by a transfer device male member (e.g., the male member 162 of the syringe 150 described above with reference to FIG. 4). In the embodiment depicted in FIGS. 8, 9, and 11, a stress concentrating member 291 is disposed on proximal end 285 of protuberance 282. Stress concentrating member 291 is constructed so as to concentrate a downward forced applied by syringe 150 against distal end 284 of protuberance 282, thereby providing a concentrated force to a single point on wall portion 272. It will be appreciated that stress concentrating member 291 can have a variety of forms. Stress concentrating member 291 is depicted in the accompanying figures as having a substantially pyramidal configuration. The process for connecting the closure body spout 256 to such a transfer device is described in detail hereinafter.

Preferably, the closure 200 also includes a peelable, removable film 294 that is sealed across the top of the closure body and that is also sealed to the peripheral, annular deck 252 at the top of the ferrule 251. The film 294 preferably includes a laterally extending pull tab 296 by which the film 294 can be grasped for pulling the film off of the closure body 230 and ferrule 251. The peelable film 294 may be provided with an adhesive backing for securing the film 294 to the closure. Alternatively, a separate securement system may be provided, such as a separate layer of adhesive, a heat seal, or the like. The film 294 functions to maintain the upper portion of the closure body 230 in a sterile condition and to prevent contaminant ingress.

When it is desired to gain access to the product within the vial 22, the film 294 is removed. Next, the syringe 150, or other suitable fluid transfer device, is brought into engagement with the closure body 230 by inserting male member 262 into closure body 230. As above-discussed, closure 220 can be accessed using a variety of fluid transfer devices. The fluid transfer device depicted in the accompanying figures is a luer lock syringe. The luer lock syringe is depicted for illustrative purposes only and is not intended to limit the present invention to luer lock applications.

When sufficient force is applied by the syringe male member 162, the frangible connecting web 276 ruptures around the edge of the disk-like transverse seal wall portion or flap 272. The wall portion 272 is pushed downwardly and pivots about the hinge connection 278. This opens a path for flow of fluid from or into the vial 22. The liquid contents within the vial 22 can flow past the flap-like transverse wall portion 272, through the spout passage 258, and into the bore 264 in the syringe male member 162. As the syringe plunger 154 is retracted, the liquid contents within the vial 22 are drawn into the syringe. Bore 264 preferably is configured to provide a substantially fluid-tight seal with the exterior wall of male member 262, thereby preventing leakage of the contents of container 22.

When the syringe 150 is disengaged from the closure 200, the inherent resiliency of the closure body material causes the hinge connection 278 to pivot the flap-like transverse wall portion 272 upwardly back toward the initial orientation that it had prior to rupture of the frangible web 276. This substantially closes or occludes the spout passage 258. Preferably closure 200 is constructed such that little or no liquid will drain out when vial 22 is inverted.

Figure 12:
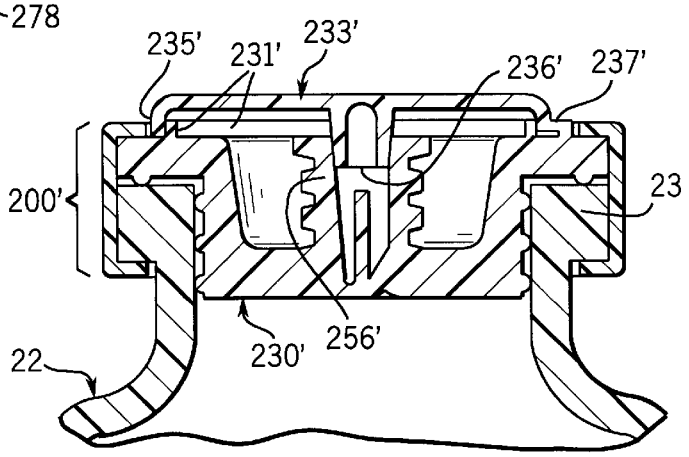
FIG. 12 is a view similar to FIG. 11, but FIG. 12 shows the lid in a closed position on the closure.

If desired, the closure 200 can be modified to include a hinged lid. FIG. 12 shows an alternate embodiment of a closure 200' on a vial 22. The alternate embodiment of the closure 200' includes a closure body 230' which is similar to the closure body 230 described above with reference to FIGS. 6–11. The closure body 230' has a spout 256', but the body 230' differs from the closure body 230 in that the top of the closure body 230' includes an annular collar 231'. A lid 233' is adapted to be disposed on the top of the closure body 230', and the lid 233' includes an annular skirt 235' which is disposed radially outwardly of, but adjacent to, the closure body collar 231'. The lid 233' may include a plug 236' for sealing the inside of the spout 256'.

The lid 233' is preferably hinged to the closure body 230' with a thin, flexible hinge 237'. The hinge 237' preferably permits the lid 233' to be opened at least 90° or more so as to accommodate connection of the fluid transfer device, such as the syringe 150.

Preferably, the closure 200' includes a latch system diametrically opposite the hinge 237'. Such a latch system (not illustrated) may be a suitable conventional or special system including an inwardly extending rib or other formation on the inside of the lid skirt 235' and including a receiving notch on the adjacent exterior surface of the closure body collar 231'. The detailed structure and operation of such a conventional or special latching system forms no part of the present invention.

The closure 200' accommodates the use of an optional, peelable seal (not illustrated) similar to the peelable seal 294 described above with reference to the embodiment of the closure 200 illustrated in FIGS. 6–11. Such a peelable seal could be applied by the manufacturer to the top of the closure body 230' and spout 256' within the collar 231', and the closure 200' would be provided to the user with the lid 233' in the open condition. The lid 233' would not be closed until after the peelable seal is removed from the top of the spout 256' by the user. If desired, a removable sterile cap (not shown) could be initially provided by the manufacturer on the lid plug 236' to keep the plug 236' sterile until the user desires to close the lid 233'.

The embodiments of the closure of the present invention described herein offer a number of advantages over conventional designs. The closure components are readily fabricated from a variety of materials, including materials that are very effective barriers to oxygen. The closure components can be manufactured and assembled on a vial without creating pyrogenic particulates inside the vial.

The closure of the present invention can be readily fabricated from materials which, when in intimate contact with a product, such as a drug in the vial, will not absorb the drug.

The closure of the present invention provides an easily assembled and manufactured seal which is effective to prevent ingress of contaminants.

Further, if the closure is intended to be used with a plastic, e.g., polypropylene, vial, the closure can be made from a material that will permit the closure to be ultrasonically or radio frequency welded to the vial flange.

The closure, after it is sealingly secured to the vial, may be terminally sterilized by suitable conventional or special sterilization processes (the details of which form no part of the present invention). The closure system of the present invention is compatible with conventional drug packaging processes such as lyophilization, sterile filling, and the like.

The closure can be readily manufactured for a variety of standard size vials, such as 20 mm diameter vials (which may be glass, polypropylene, or other materials).

If a peelable seal, such as the seal 294 (FIG. 7) or 294' (FIG. 12) is used, the seal may be made from a variety of materials, including Tyvek brand film, polypropylene, or other materials, and these may be radio frequency welded or laminated to the top face of the closure body. Such a peelable seal may be color coded to indicate the contents of the vial. If a cover or lid is provided, the cover or lid may also be color coded.

The closure is suitable for being sterilized by radiation, and the interior surfaces of the closure which are intended to engage, and be coupled with, a syringe or other fluid transfer device will remain sterile until the vial contents are accessed.

The closure may be readily assembled from its separate components as a subassembly which can then be applied to a vial by conventional capping machinery.

The closure accommodates multi-dose vials and operations whether or not the closure includes an integral lid (such as lid 233' (FIG. 12)). Such a multi-dose vial can be first used by peeling away the first film seal (e.g., seal 294 in FIGS. 6 and 7) and then inserting the fluid transfer device. After such a multi-dose vial is subsequently disconnected from the fluid transfer device, the medical professional can close the lid if the closure has such a lid. If the closure does not have such a lid, the medical professional can apply a new (second) sterile film seal over the spout opening and secure the second film seal to the surrounding top surfaces of the closure body.

If the closure is initially provided to the user with a first peelable film seal over the spout (such as film seal 294 in FIGS. 6 and 7), and with an integral, open lid without a plug (e.g., a lid 233' without a plug 236' (FIG. 12)), then a second sterile film seal could also be initially packaged by the manufacturer as part of the closure so that the second film seal is initially secured to the inside of the open lid. After the first film seal is removed from the spout and some of the vial contents are initially withdrawn, the second film seal stored in the lid can be peeled off, and the second film seal can then be reapplied across the top of the closure body to seal the spout closed. This may be done under a sterile filling hood to further minimize the possibility of contamination of the adhesive side of the second film seal. The lid could then be closed over the top of the closure to protect the second film seal on the spout until it is again desired to remove the seal and withdraw more fluid from the container.

All of the closure embodiments and modifications that have been described accommodate direct connection of a syringe to the closure without requiring the use of a needle or other sharp, pointed object. This eliminates or greatly minimizes the likelihood that the medical professional could cause a skin puncture when using the closure as designed.

Finally, the embodiments of the closure of this invention and modifications to them described herein provide evidence of tampering. Because the closure embodiments incorporate a frangible seal, the condition of a broken seal can be readily observed as indication that the closure has been opened or otherwise tampered with.

It will be readily apparent from the foregoing detailed description of the invention and from the illustrations thereof that numerous variations and modifications may be effected without departing from the true spirit and scope of the novel concepts or principles of this invention.

What is claimed is:

1. A closure for mounting across the mouth of a container and through which fluid can be transferred using a fluid transfer device, said closure comprising:

a body to be disposed on said container across said container mouth to initially occlude said container mouth, said body defining a passage having an exterior opening to receive a fluid transfer device; and a frangible seal initially extending across said passage to sealingly occlude said passage, said frangible seal including a generally flap-like transverse wall portion having a first peripheral section frangible connected to an adjacent region of said body and a second peripheral section defining a hinge connecting the transverse wall portion to the body, the frangible connection for the first peripheral portion constructed to be broken when engaged by a fluid transfer device to open the transverse wall portion about the hinge and establish fluid communication between the fluid transfer device and an interior of said container.

2. A closure in accordance with claim 1, wherein said body and said frangible seal are molded together as a unitary structure.

3. A closure in accordance with claim 1, wherein said frangible seal further includes an engaging protuberance projecting therefrom, said protuberance having a distal end to be engaged by a portion of a fluid transfer device.

4. A closure in accordance with claim 1, wherein said frangible seal has a stress concentrating element disposed to concentrate force applied by a fluid transfer device to initiate breakage of the frangible connection for the first peripheral section.

5. A closure in accordance with claim 1, wherein said closure further includes a peelable film sealingly secured to a portion of said body and extending over said passage exterior opening.

6. A closure in accordance with claim 1, wherein said closure further includes a lid and a hinge connecting said lid to said body, said lid constructed to cover said passage exterior opening in said body.

7. A closure in accordance with claim 1, wherein said closure further includes a metal ferrule having an annular deck constructed to retain a marginal portion of said body, said ferrule further having a skirt depending downwardly from said deck.

8. A closure in accordance with claim 1, wherein said body has a connector spout defining at least a portion of said passage.

9. A closure in accordance with claim 8, wherein the connector spout has a laterally projecting formation to engage a luer lock syringe.

10. A closure in accordance with claim 1, wherein the frangible connection for the first peripheral section includes a frangible connecting web of reduced thickness frangibly connecting the first peripheral section of said flap-like transverse wall portion to the adjacent region of said body, the second peripheral section of said flap-like transverse wall portion being permanently connected to said body to define the hinge.

11. A closure in accordance with claim 10, wherein the frangible seal is constructed of a material having a sufficient resiliency to effect return of said flap-like transverse wall portion substantially to its initial, unbroken orientation occluding said passage after removal of a fluid transfer device used to open the flap-like transverse wall portion.

12. A closure for a container, said closure comprising:

a body to be disposed across a mouth of the container, said body defining a passage therethrough, said passage having an exterior opening to receive a fluid transfer device; and a frangible seal disposed across said passage of said body, said frangible seal fluidly sealing said passage, said frangible seal including a stress concentrator disposed on the frangible seal to concentrate force applied by a fluid transfer device received by said passage of said body and initiate breakage of the frangible seal.

13. A closure for a container in accordance with claim 12, wherein said frangible seal further includes a protuberance extending therefrom, and wherein said stress concentrator is disposed at a proximal end of said protuberance.

14. A closure in accordance with claim 12, wherein the frangible seal includes a generally flap-like transverse wall portion having a first peripheral section frangibly connected to an adjacent region of the body of the closure and a second peripheral section defining a hinge connecting the transverse wall portion to the body, the frangible connection for the first peripheral portion constructed to be broken initially by the stress concentrator when force is applied by a fluid transfer device to open the transverse wall portion about the hinge.

15. A container assembly for containing a product, the assembly comprising:

a container having a chamber defined therein, the container further defining a mouth in fluid communication with the chamber; and a closure mounted across the container mouth through which a product can be transferred using a transfer device, the closure including a body disposed across said container mouth, said body defining a passage having an exterior opening to receive a transfer device; and a frangible seal initially extending across said passage to sealingly occlude said passage, said frangible seal including a generally flap-like transverse wall portion having a first peripheral section frangibly connected to an adjacent region of said body and a second peripheral section defining a hinge connecting the transverse wall portion to the body, the frangible connection for the first peripheral portion constructed to be broken by a transfer device to open the transverse wall portion about the hinge and establish fluid communication between the transfer device and the chamber of said container.

16. A container assembly in accordance with claim 15, wherein the container is selected from the group consisting of a bottle, a vial, a bag, and a tube set.

17. A container assembly in accordance with claim 15, wherein the frangible connection for the first peripheral section includes a frangible connecting web of reduced thickness frangibly connecting the first peripheral section of said flap-like transverse wall portion to the adjacent region of said body, the second peripheral section of said flap-like transverse wall portion being permanently connected to said body to define the hinge.

18. A container assembly in accordance with claim 15, wherein the frangible seal is constructed of a material having a sufficient resiliency to effect return of said flap-like transverse wall portion substantially to its initial, unbroken orientation occluding said passage after removal of a transfer device used to open the flap-like transverse wall portion.

19. A container assembly in accordance with claim 15, wherein said frangible seal further includes an engaging protuberance projecting therefrom, said protuberance having a distal end to be engaged by a transfer device.

20. A container assembly in accordance with claim 15, wherein said frangible seal has a stress concentrating element disposed to concentrate force applied by a transfer device to initiate breakage of the frangible connection for the first peripheral section.

* * * * *